US009526343B1

(12) United States Patent
Wu

(10) Patent No.: US 9,526,343 B1
(45) Date of Patent: Dec. 27, 2016

(54) FOOTREST ASSEMBLY OF A CHAIR

(71) Applicant: Yao-Chuan Wu, Chiayi Hsien (TW)

(72) Inventor: Yao-Chuan Wu, Chiayi Hsien (TW)

( * ) Notice: Subject to any disclaimer, the term of this patent is extended or adjusted under 35 U.S.C. 154(b) by 0 days.

(21) Appl. No.: 14/752,486

(22) Filed: Jun. 26, 2015

(51) Int. Cl.
*A47C 7/50* (2006.01)
*A47C 20/00* (2006.01)
*A47C 20/04* (2006.01)

(52) U.S. Cl.
CPC ..... *A47C 7/506* (2013.01)

(58) Field of Classification Search
CPC ..... A47C 7/506
USPC ..... 297/423.26, 423.28, 423.3
See application file for complete search history.

(56) References Cited

U.S. PATENT DOCUMENTS 2,684,708 A * 7/1954 Luketa ..... A47C 1/0246 297/423.26 X
5,039,167 A * 8/1991 Sweet ..... A47C 1/04 297/423.28
5,352,020 A * 10/1994 Wade ..... B60N 2/4495 297/423.26 X
5,725,281 A * 3/1998 Vairinen ..... A47C 1/03 297/423.26
6,264,278 B1 * 7/2001 Weimer ..... B60N 2/28 297/423.26 X
6,267,445 B1 * 7/2001 Marais ..... B64D 1/06 297/423.26
6,652,033 B2 * 11/2003 Satoh ..... B60N 2/0292 297/423.3 X
6,659,562 B2 * 12/2003 Uchiyama ..... A47C 7/506 297/423.3 X
6,663,184 B2 * 12/2003 Hagiike ..... B60N 2/0292 297/423.3 X
6,695,406 B2 * 2/2004 Plant ..... B60N 2/34 297/423.26
6,752,463 B2 * 6/2004 Nivet ..... B60N 2/0224 297/423.3 X
6,773,074 B2 * 8/2004 Flory ..... B60N 3/063 297/423.26 X
6,874,855 B2 * 4/2005 Nivet ..... A47C 1/0242 297/423.3 X
6,916,069 B2 * 7/2005 Bauer ..... A47C 1/0352 297/423.3
7,273,257 B2 * 9/2007 De Vroe ..... A47C 1/035 297/452.26 X
8,444,225 B2 * 5/2013 Behe ..... B64D 11/0643 297/423.26 X
8,534,762 B2 * 9/2013 Linhoff ..... A47C 7/506 297/423.26

(Continued)

*Primary Examiner* — Rodney B White
(74) *Attorney, Agent, or Firm* — Birch, Stewart, Kolasch & Birch, LLP

(57) ABSTRACT

A footrest assembly disposed under a chair includes an assembly, a tracking frame, a first rotating plate, a second rotating plate and a footrest. The tracking frame is movably mounted in the seat mounting frame. The first rotating plate is pivotally connected to the tracking frame. The second rotating plate is pivotally connected to the first rotating plate. The footrest is mounted on the second rotating plate. By disposing the two rotating plates between the footrest and the tracking frame, the footrest can rotate twice relative to the tracking frame, so as to increase a distance between the footrest and the tracking frame. That is, a distance between the footrest and the chair is increased, so as to meet users' various needs.

14 Claims, 8 Drawing Sheets

(56) References Cited

U.S. PATENT DOCUMENTS

| | | | | |
|---|---|---|---|---|
| 2003/0075966 | A1* | 4/2003 | Behnert | B60N 2/4495 297/423.26 |
| 2005/0173963 | A1* | 8/2005 | Edrich | B60N 2/4495 297/423.28 |
| 2010/0194169 | A1* | 8/2010 | Shinozuka | B60N 2/4495 297/423.26 |
| 2015/0021969 | A1* | 1/2015 | Yin | B64D 11/0643 297/423.26 |
| 2015/0274053 | A1* | 10/2015 | Carlioz | B64D 11/06 297/423.26 |

* cited by examiner

FOOTREST ASSEMBLY OF A CHAIR

BACKGROUND OF THE INVENTION

1. Field of the Invention

The present invention relates to a footrest disposed on a bottom of a chair.

2. Description of the Related Art

Many kinds of conventional chairs each have a footrest disposed on a bottom of a chair. A side of the footrest is pivotally connected to a tracking frame, and the tracking frame is movably mounted in the chair. When the footrest is in use, the footrest and the tracking frame are pulled out from the chair, and the footrest is rotated relative to the tracking frame, such that the footrest can support a user's feet. For storage, the footrest is rotated reversely, and then the footrest and the tracking frame are pushed into the chair, so as to prevent the footrest from occupying too much space.

However, structural disadvantages of the conventional footrest are as follows.

First, a distance that the footrest can be pulled out from the chair is limited to a length of the tracking frame. In addition, in order to fully fold the tracking frame in the chair, the length of the tracking frame is also limited, such that the distance that the footrest can be pulled out is too short to meet users' various needs.

Second, when the footrest is rotated relative to the tracking frame, the footrest can only be rotated to be horizontal but cannot be fixed at any angle, which also cannot meet users' various needs.

SUMMARY OF THE INVENTION

The main objective of the present invention is to provide a footrest assembly of a chair that can increase a relative distance between a footrest and a chair.

The footrest assembly comprises a seat mounting frame, a tracking frame, a first rotating plate, a second rotating plate and a footrest. The tracking frame has a first side movably mounted in the seat mounting frame and a second side disposed opposite to the first side. The first rotating plate has a third side pivotally connected to the second side of the tracking frame and a fourth side disposed opposite to the third side. The second rotating plate has a fifth side pivotally connected to the fourth side of the first rotating plate and a sixth side disposed opposite to the fifth side. The footrest is mounted on the second rotating plate.

The advantage of the invention is that the footrest is rotatable twice relative to the tracking frame by disposing two rotating plates between the footrest and the tracking frame, so as to increase a distance between the footrest and the tracking frame. That is, a distance between the footrest and the chair is increased, so as to meet users' various needs.

Other objectives, advantages and novel features of the invention will become more apparent from the following detailed description when taken in conjunction with the accompanying drawings.

DETAILED DESCRIPTION OF THE INVENTION

Figure 1:
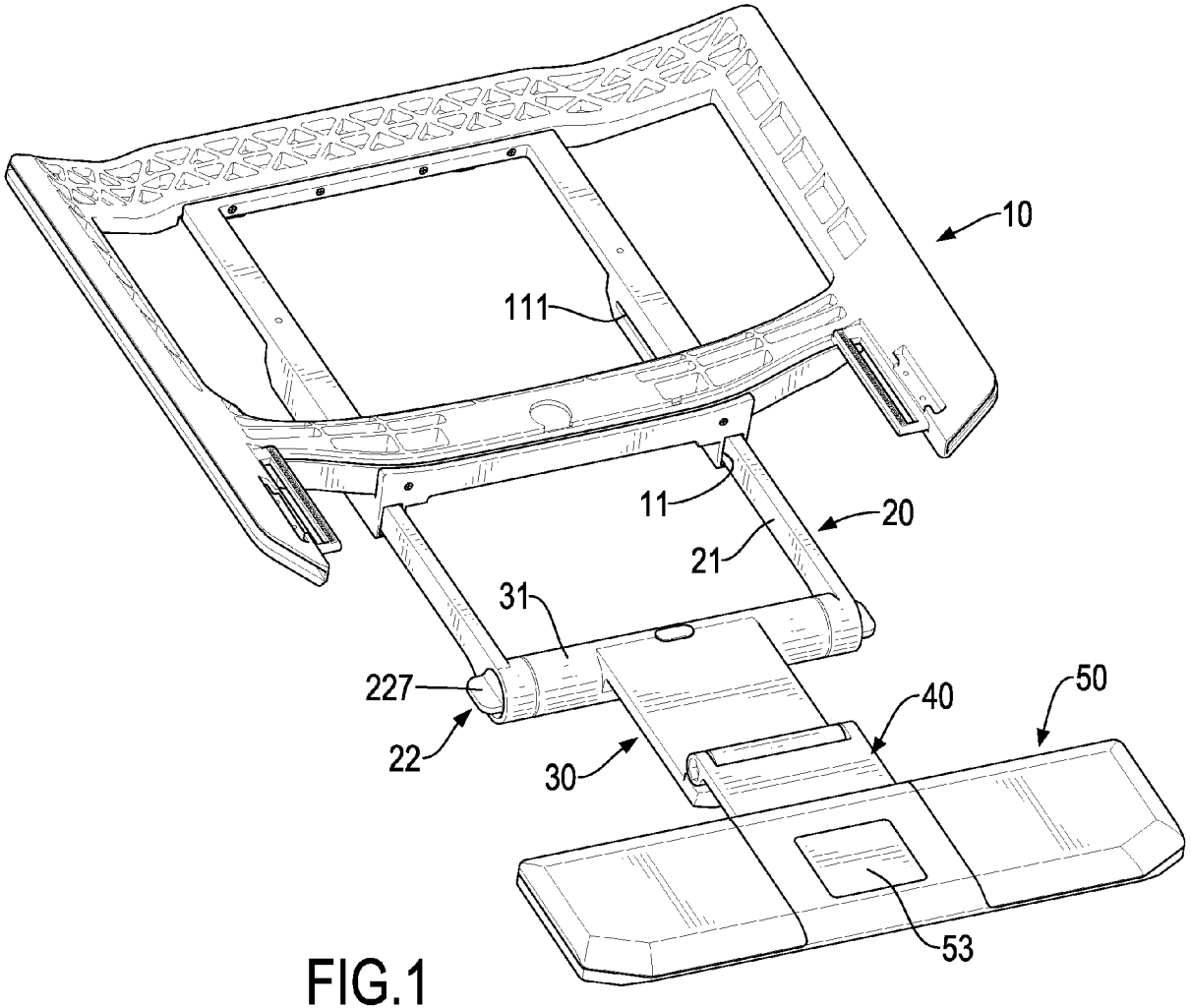
FIG. 1 is a perspective view of a footrest assembly of a chair in accordance with the present invention, shown fully expanded.

With reference to FIG. 1, a footrest assembly of a chair in accordance with the present invention comprises a seat mounting frame 10, a tracking frame 20, a first rotating plate 30, a second rotating plate 40 and a footrest 50.

Figure 2:
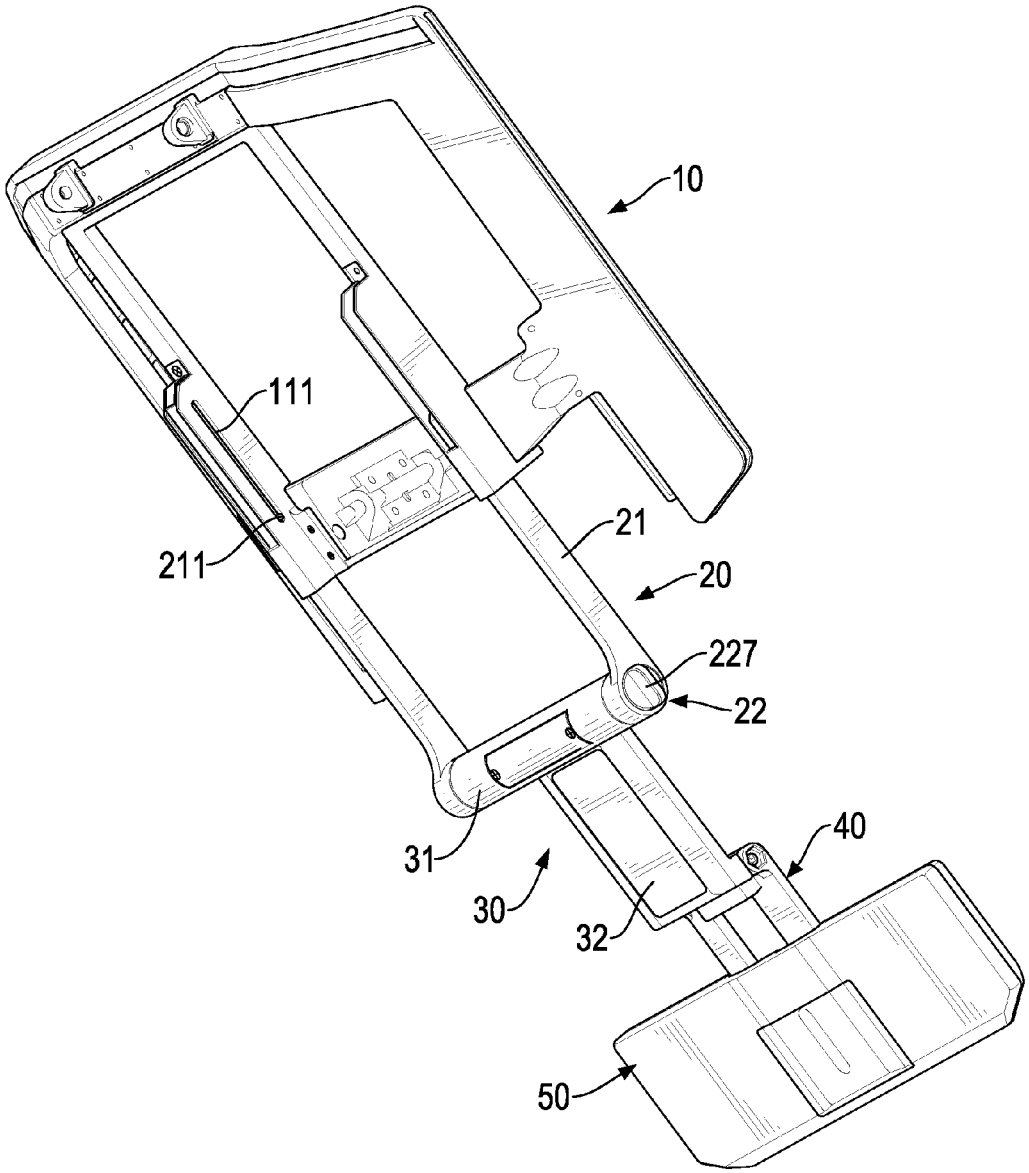
FIG. 2 is another perspective view of the footrest assembly in FIG. 1, shown expanded.

With reference to FIG. 1 and FIG. 2, the seat mounting frame 10 is mounted on a bottom of a chair. Two tracking slots 11 are formed in a front side of the seat mounting frame 10, and the two tracking slots 11 are disposed in parallel and are spaced apart at a distance. A restraining hole 111 is formed through an inner surface of each tracking slot 11, and the restraining hole 111 is a front-rear elongated hole.

A first side of the tracking frame 20 is movably mounted in the seat mounting frame 10 and can move forward and backward. The tracking frame 20 includes two sliding rods 21 and a shaft assembly 22. The two sliding rods 21 are disposed in parallel and are transversely spaced apart at a distance. The two sliding rods 21 are movably mounted in the two tracking slots 11 of the seat mounting frame 10. A restraining component 211 is disposed on each of the two sliding rods 21, and the restraining component 211 is movably mounted through the restraining holes 111 of the tracking slots 11, so as to prevent the tracking frame 20 from separating from the seat mounting frame 10. In this embodiment, the restraining component 211 can be, but is not limited to, a screw.

With reference to FIG. 3 to FIG. 6, the shaft assembly 22 is mounted between two front ends of the two sliding rods 21, and the shaft assembly 22 includes a fixing sleeve 221, a central column 222, two engaging components 223, two resilient components 224, two sheathes 225, two anti-friction sleeves 226 and two knobs 227. The fixing sleeve 221 is mounted between two front ends of the two sliding rods 21. Two holes 2211 are formed through the fixing sleeve 221. The two holes 2211 are disposed in parallel and are spaced apart at a distance. The central column 222 is rotatably mounted through the fixing sleeve 221. Two recesses 2221 are formed in an outer wall of the central column 222, and the two recesses 2221 communicate with the two holes 2211. The two engaging components 223 are pivotally mounted in the two holes 2211 of the fixing sleeve 221 respectively. Each of the engaging components 223 is pivotally connected to the fixing sleeve 221 by a pivot, and the pivot is mounted between the engaging component 223 and the fixing sleeve 221, and is disposed parallel to an axis of the fixing sleeve 221. Two outer gear portions 2231 are formed on an outer wall of the engaging component 223, are disposed toward the holes 2211, and are annularly arranged apart from each other around the axis of the fixing sleeve 221. The two outer gear portions 2231 are spaced between the axis of the fixing sleeve 221. The two resilient components 224 are mounted in the two recesses 2221 of the central column 222 and abut two inner walls of the two engaging components 223 respectively. The resilient component 224 pushes different positions of the inner wall of the corresponding engaging components 223 to rotate the engaging components 223 until one of the outer gear portions 2231 protrudes out of the hole 2211 of the fixing sleeve 221. In this embodiment, the resilient component 224 can be, but is not limited to, a spring. The two sheathes 225 are mounted around the two resilient components 224 respectively and mounted in the two recesses 2221. The two anti-friction sleeves 226 are mounted on a position on the fixing sleeve 221 corresponding to the two holes 2211. The two knobs 227 are mounted on two ends of the central column 222 respectively and are disposed outside the fixing sleeve 221.

Figure 3:
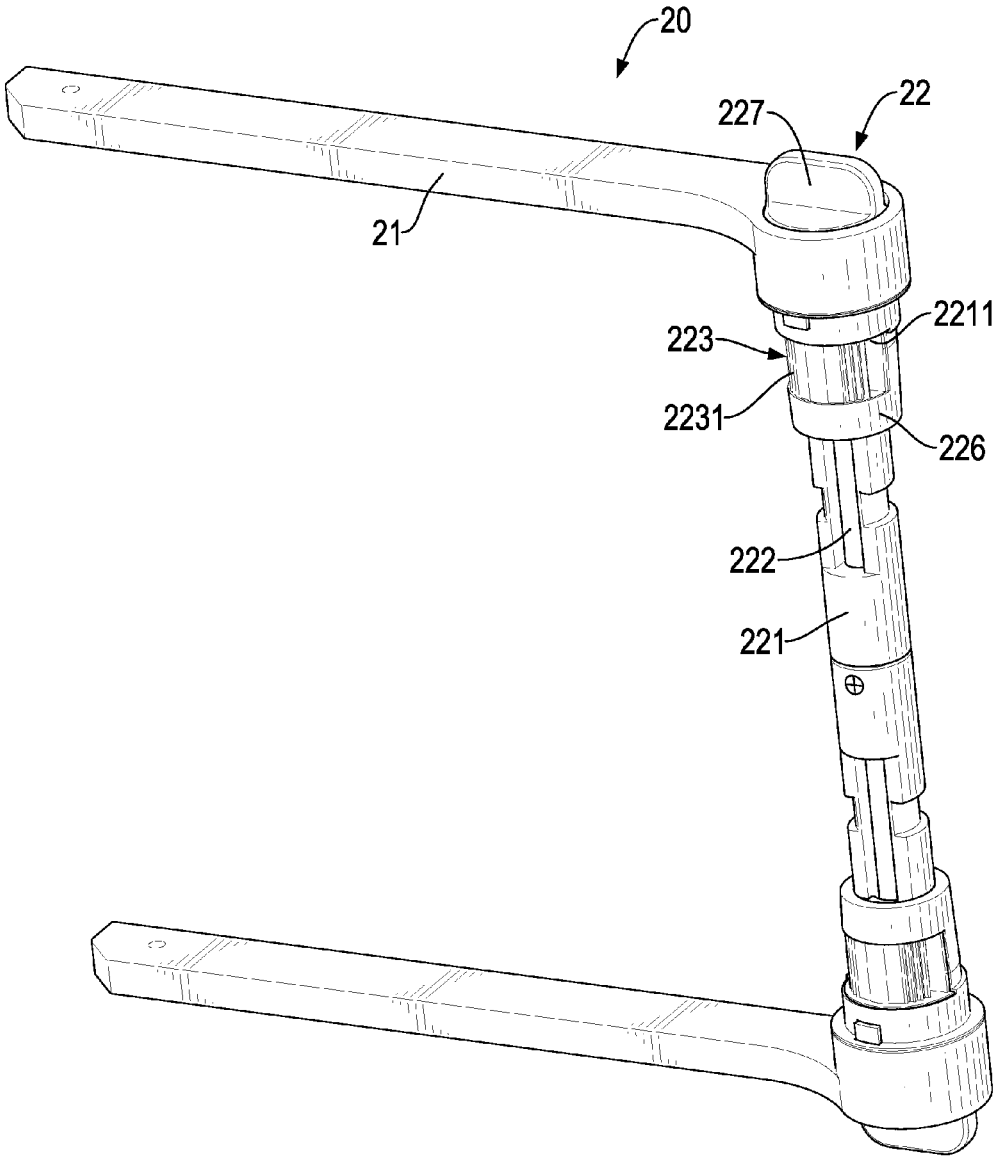
FIG. 3 is a perspective view of a tracking frame of the footrest assembly in FIG. 1.
Figure 4:
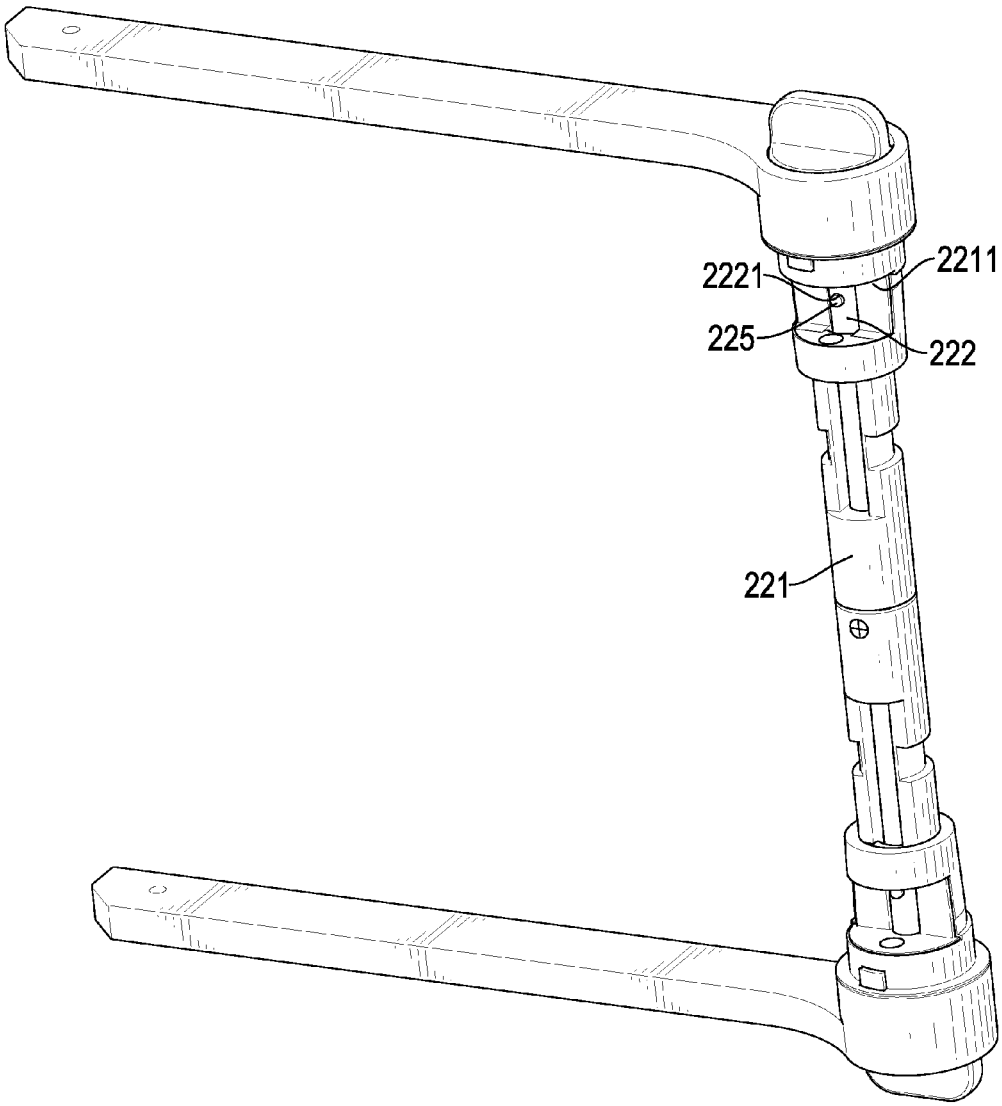
FIG. 4 is a partial exploded perspective view of the tracking frame in FIG. 3.
Figure 5:
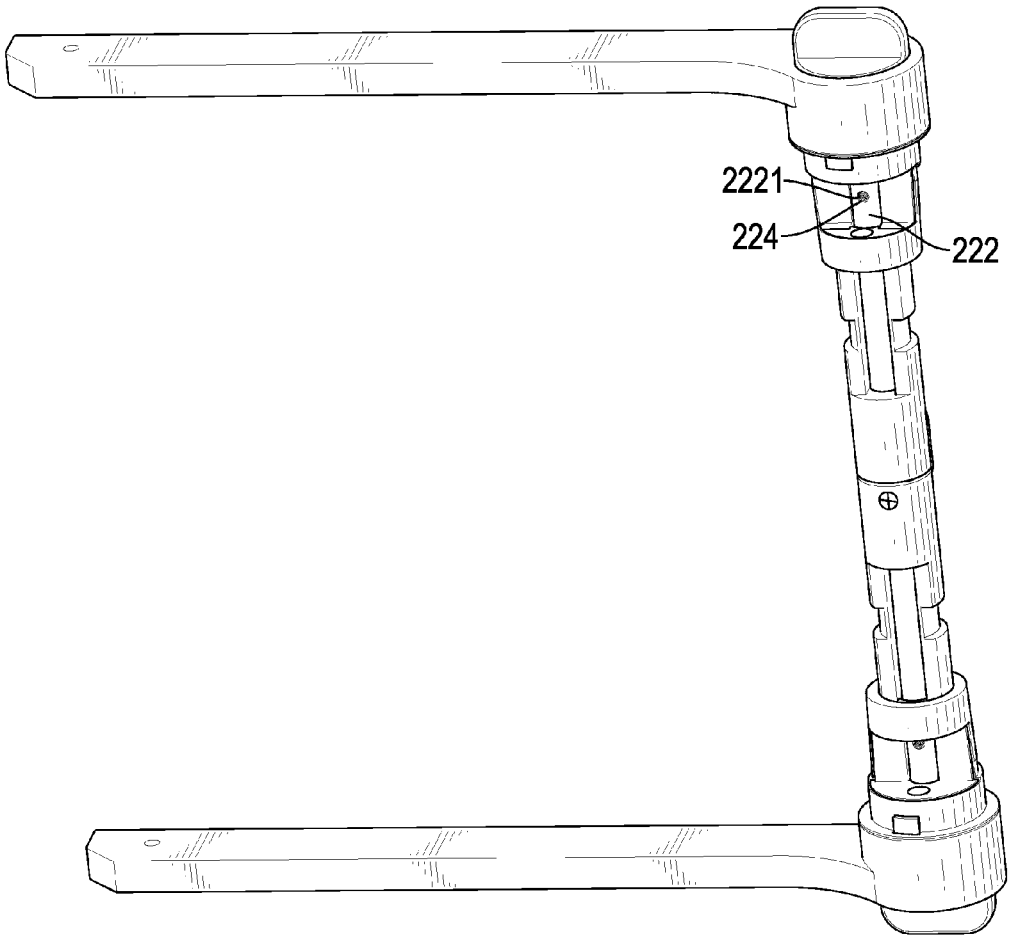
FIG. 5 is another partial exploded perspective view of the tracking frame in FIG. 3.
Figure 6:
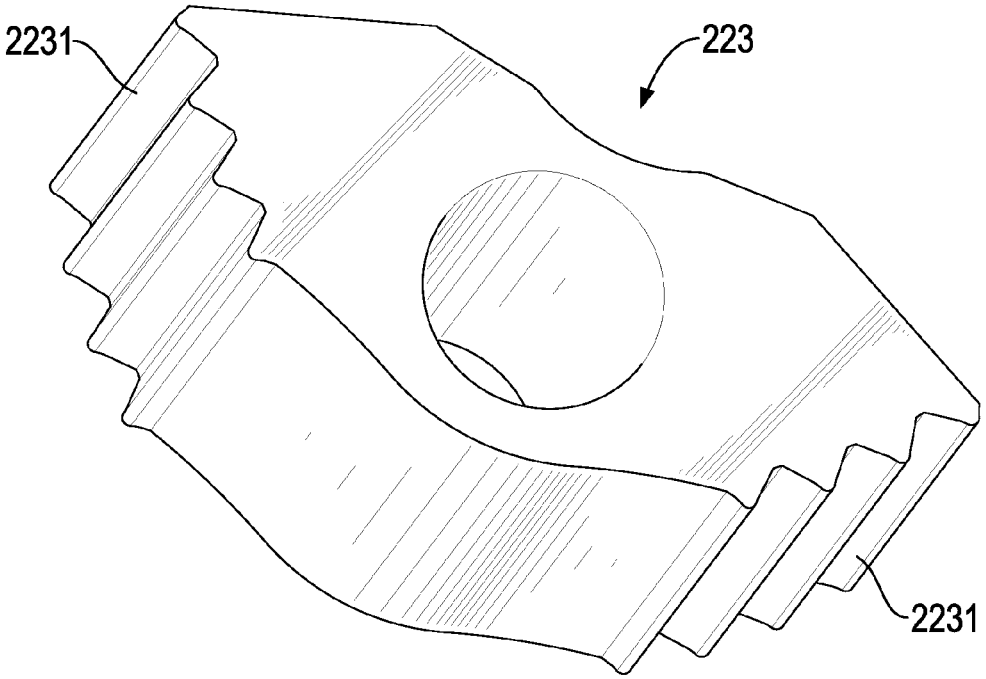
FIG. 6 is a perspective view of an engaging component of the footrest assembly in FIG. 1.
Figure 7:
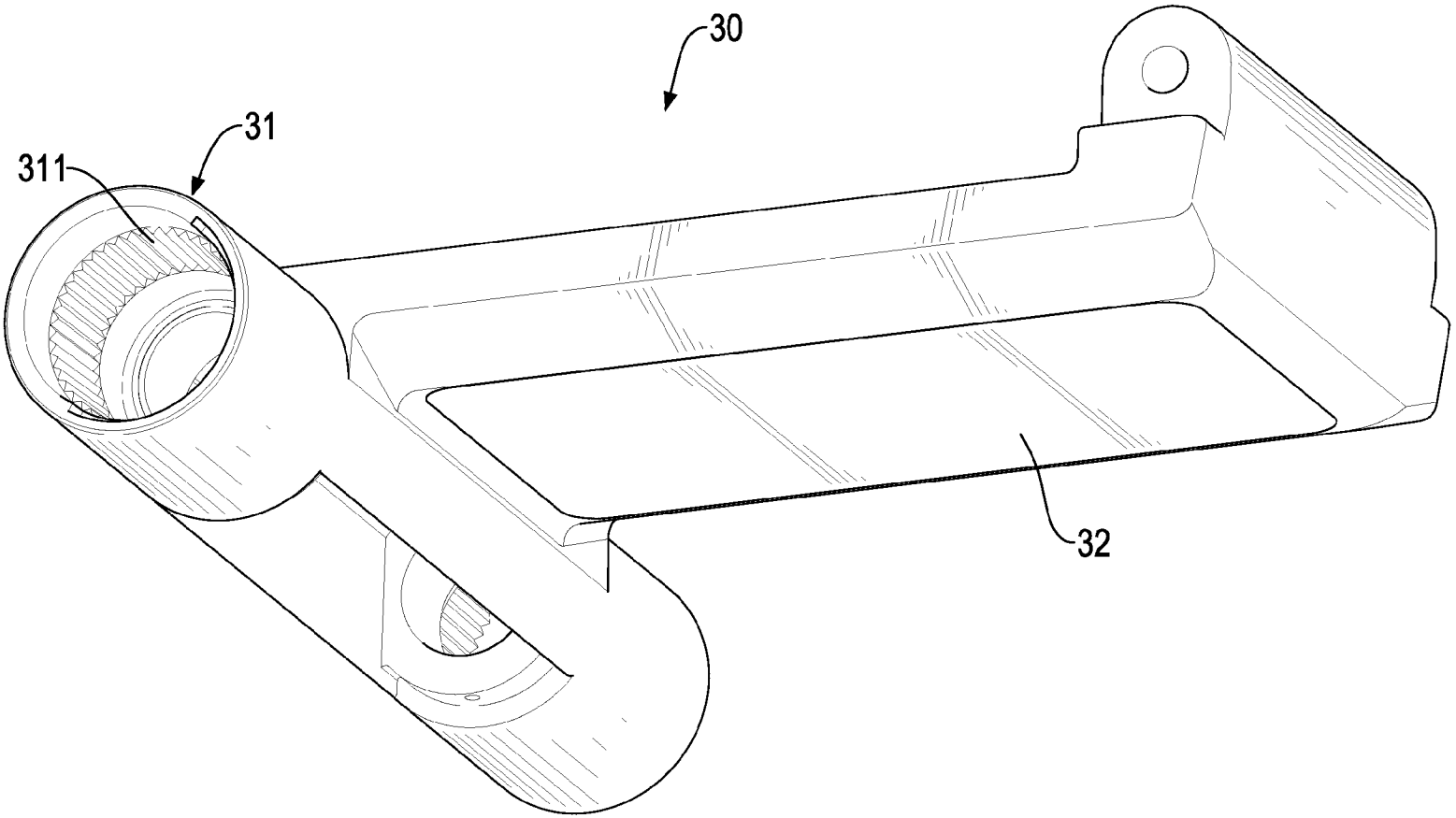
FIG. 7 is a perspective view of a first rotating plate of the footrest assembly in FIG. 1.

With reference to FIG. 3 and FIG. 7, a third side of the first rotating plate 30 is pivotally connected to a second side of the tracking frame 20, and the third side of the first rotating plate 30 includes a rotating sleeve 31. The rotating sleeve 31 is rotatably mounted around the shaft assembly 22 of the tracking frame 20. The anti-friction sleeve 226 of the shaft assembly 22 can make the rotating sleeve 31 rotate relative to the shaft assembly 22 more smoothly. Two annular gear portions 311 are formed on an inner surface of the rotating sleeve 31, and each of the two gear portions 311 extends annularly in 360 degrees. The two annular gear portions 311 are engaged with the two engaging components 223 of the shaft assembly 22 respectively, and each of the two annular gear portions 311 is engaged with a respective one of the two engaging components 223 by engaging with one of the two outer gear portions 2231 of said engaging component 223. A magnet 32 is mounted on a bottom of the first rotating plate 30.

Figure 8:
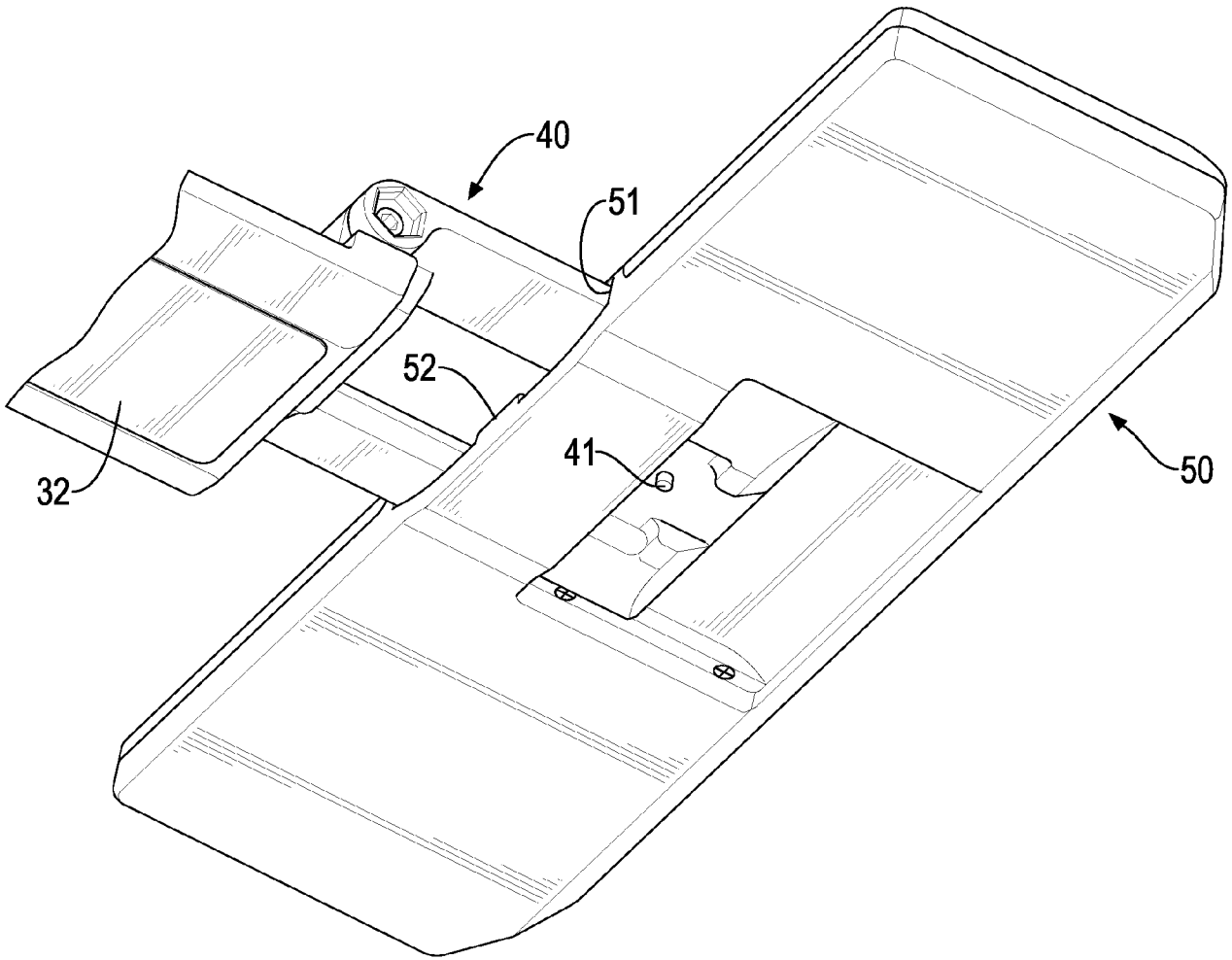
FIG. 8 is a perspective view of a footrest and a second rotating plate of the footrest assembly in FIG. 1.

With reference to FIG. 1 and FIG. 8, a fifth side of the second rotating plate 40 is pivotally connected to a fourth side of the first rotating plate 30, and a restraining portion 41 is formed on a top surface of the second rotating plate 40.

A rear side of the footrest 50 is movably mounted on a sixth side of the second rotating plate 40. A slot 51 is formed in the rear side of the footrest 50, and the slot 51 is disposed around the sixth side of the second rotating plate 40. A restraining portion 52 is formed on an inner surface of the slot 51. The restraining portion 52 of the footrest 50 and the restraining portion 41 of the second rotating plate 40 selectively abut each other, so as to prevent the footrest 50 from separating from the second rotating plate 40. A magnetic piece 53 is mounted on a top surface of the footrest 50, and the magnetic piece 53 is an iron piece in this embodiment. The magnet 32 on the first rotating plate 30 and the magnetic piece 53 on the footrest 50 selectively magnetically attract each other.

As shown in FIG. 1 and FIG. 2, the footrest assembly is unfolded completely. Because the first rotating plate 30 and the second rotating plate 40 are disposed between the footrest 50 and the tracking frame 20, the footrest 50 can rotate twice relative to the tracking frame 20, so as to increase a distance between the footrest 50 and the tracking frame 20. In addition, the tracking frame 20 can move relative to the seat mounting frame 10, and the footrest 50 can move relative to the second rotating plate 40, so as to adjust a distance between the footrest 50 and a chair (the seat mounting frame 10).

Furthermore, to rotate the first rotating plate 30 relative to the tracking frame 20, the knob 227 of the shaft assembly 22 of the tracking frame 20 is rotated first. The knob 227 drives the central column 222 and the resilient component 224 on the central column 222, such that the resilient component 224 contacts different positions of the inner wall of the engaging components 223. As viewed from end of the shaft assembly 22, when the knob 227 rotates clockwise, the resilient component 224 rotates with the knob 227 to contact a left side of the inner wall of the engaging component 223, such that a right side of the outer wall of the engaging component 223 protrudes out of the hole 2211 of the fixing sleeve 221. At this time, a right outer gear portion 2231 engages with the annular gear portion 311 of the rotating sleeve 31 of the first rotating plate 30. If it is desired to rotate the first rotating plate 30 counterclockwise, the outer gear portion 2231 will engage with the annular gear portion 311 more tightly. Therefore, after the knob 227 is rotated, the first rotating plate 30 only can rotate clockwise relative to the tracking frame 20. In contrary, when the knob 227 is rotated counterclockwise, the first rotating plate 30 only can rotate counterclockwise relative to the tracking frame 20. As a result, a user can rotate the first rotating plate 30 relative to the tracking frame 20 to a desired angle, and then rotate the knob 227 reversely to fix the first rotating plate 30 at the desired angle. Furthermore, the annular gear portion 311 extends annularly in 360 degrees, such that the first rotating plate 30 can be fixed at any angle.

In conclusion, the invention can maximize the distance between the footrest 50 and the chair. The distance can be adjusted in two positions, and the first rotating plate 30 can be fixed at any angle with the footrest 50, so as to meet users' various needs.

After the footrest assembly of the invention is folded, the first rotating plate 30 rotates to a position under the seat mounting frame 10, and the first rotating plate 30 is supported at a relative angle by an engagement between the shaft assembly 22 and the rotating sleeve 31. The second rotating plate 40 and the footrest 50 rotate to a position under the first rotating plate 30, and the magnet 32 of the first rotating plate 30 attracts the magnetic piece 53 of the footrest 50, so as to fix a relative angle between the first rotating plate 30 and the second rotating plate 40.

In another embodiment, the footrest also can be fixed on the second rotating plate 40, so as to rotate the first rotating plate 30 and the second rotating plate 40 to maximize the distance between the footrest 50 and the chair.

In another embodiment, the shaft assembly 22 of the tracking frame 20 can only include a single engaging component 223 and a single resilient component 211, the fixing sleeve 221 can only include a single hole 2211, the rotating sleeve 31 of the first rotating plate 30 can only include a single annular gear portion 311, and the purpose of supporting the first rotating plate 30 at a specific angel can still be achieved.

In another embodiment, the shaft assembly 22 of the tracking frame 20 can only include a single knob 227, and the central column 222 can still be rotated.

In another embodiment, the shaft assembly 22 of the tracking frame 20 can be other structures. Any structures for fixing or supporting the first rotating plate 30 at the specific angle are within the scope of the present invention.

In another embodiment, the tracking frame 20 can include a single sliding rod 21 or a plate mounted through the seat mounting frame 10 instead of two sliding rods 21.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A footrest assembly of a chair, the footrest assembly comprising:

a seat mounting frame;

a tracking frame having a first side movably mounted in the seat mounting frame; and a second side disposed opposite to the first side;

a first rotating plate having a third side pivotally connected to the second side of the tracking frame; and a fourth side disposed opposite to the third side;

a second rotating plate having a fifth side pivotally connected to the fourth side of the first rotating plate;

a sixth side disposed opposite to the fifth side; and a restraining portion formed on the second rotating plate; and a footrest mounted on the second rotating plate, and having a side movably mounted on the second rotating plate;

a slot formed in the side of the footrest and disposed around the second rotating plate; and a restraining portion formed on an inner surface of the slot, and selectively abutting the restraining portion of the second rotating plate.

2. The footrest assembly as claimed in claim 1, wherein the first rotating plate has a magnet mounted on the first rotating plate;

the footrest has a magnetic piece mounted on the footrest, and selectively magnetically attracting the magnet of the first rotating plate.

3. The footrest assembly as claimed in claim 2, wherein the tracking frame comprises a shaft assembly having a fixing sleeve mounted on the second side of the tracking frame, and having at least one hole formed through the fixing sleeve;

a central column rotatably mounted through the fixing sleeve, and having at least one recess formed in an outer wall of the central column, and each one of the at least one recess communicating with a respective one of the at least one hole of the fixing sleeve;

at least one engaging component, each one of the at least one engaging component pivotally mounted in a respective one of the at least one hole of the fixing sleeve, and having a pivot mounted between the engaging component and the fixing sleeve, and disposed parallel to an axis of the fixing sleeve; and two outer gear portions formed on an outer wall of the engaging component, disposed toward the hole, and annularly arranged apart from each other around the axis of the fixing sleeve;

at least one resilient component, each one of the at least one resilient component mounted in a respective one of the at least one recess of the central column, and abutting the corresponding engaging component to rotate the engaging component until one of the outer gear portions protrudes out of the hole of the fixing sleeve; and at least one knob, each one of the at least one knob mounted on a respective end of the central column and disposed outside the fixing sleeve; and the first rotating plate further has a rotating sleeve mounted on the third side of the first rotating plate, rotatably mounted around the shaft assembly, and having at least one annular gear portion formed on an inner surface of the rotating sleeve, and each one of the at least one annular gear portion engaging with a respective one of the at least one engaging component by engaging with one of the outer gear portions of said engaging component.

4. The footrest assembly as claimed in claim 3, wherein the at least one annular gear portion of the first rotating plate extends annularly in 360 degrees.

5. The footrest assembly as claimed in claim 4, wherein the shaft assembly of the tracking frame further comprises at least one anti-friction sleeve mounted between the fixing sleeve and the rotating sleeve of the first rotating plate.

6. The footrest assembly as claimed in claim 5, wherein the shaft assembly of the tracking frame further comprises at least one sheath mounted around the at least one resilient component and in the at least one recess.

7. The footrest assembly as claimed in claim 6, wherein the seat mounting frame has at least one tracking slot formed in a side of the seat mounting frame, each one of the at least one tracking slot having a restraining hole formed through an inner surface of the tracking slot; and the tracking frame is movably mounted in the at least one tracking slot of the seat mounting frame, and has at least one restraining component mounted on the tracking frame, and movably mounted through the restraining hole of the at least one tracking slot.

8. The footrest assembly as claimed in claim 7, wherein the tracking frame comprises two sliding rods disposed in parallel and transversely spaced apart at a distance, and the two sliding rods are movably mounted in the seat mounting frame.

9. The footrest assembly as claimed in claim 1, wherein the tracking frame comprises a shaft assembly having a fixing sleeve mounted on the second side of the tracking frame, and having at least one hole formed through the fixing sleeve;

a central column rotatably mounted through the fixing sleeve, and having at least one recess formed in an outer wall of the central column, and each one of the at least one recess communicating with a respective one of the at least one hole of the fixing sleeve;

at least one engaging component, each one of the at least one engaging component pivotally mounted in a respective one of the at least one hole of the fixing sleeve, and having a pivot mounted between the engaging component and the fixing sleeve, and disposed parallel to an axis of the fixing sleeve;

two outer gear portions formed on an outer wall of the engaging component, disposed toward the hole, and annularly arranged apart from each other around the axis of the fixing sleeve;

at least one resilient component, each one of the at least one resilient component mounted in a respective one of the at least one recess of the central column, and abutting the corresponding engaging component to rotate the engaging component until one of the outer gear portions protrudes out of the hole of the fixing sleeve; and at least one knob, each one of the at least one knob mounted on a respective end of the central column and disposed outside the fixing sleeve; and the first rotating plate further has a rotating sleeve mounted on the third side of the first rotating plate, rotatably mounted around the shaft assembly, and having at least one annular gear portion formed on an inner surface of the rotating sleeve, and each one of the at least one annular gear portion engaging with a respective one of the at least one engaging component by engaging with one of the outer gear portions of said engaging component.

10. The footrest assembly as claimed in claim 9, wherein the at least one annular gear portion of the first rotating plate extends annularly in 360 degrees.

11. The footrest assembly as claimed in claim 9, wherein the shaft assembly of the tracking frame further comprises at least one anti-friction sleeve mounted between the fixing sleeve and the rotating sleeve of the first rotating plate.

12. The footrest assembly as claimed in claim 9, wherein the shaft assembly of the tracking frame further comprises at least one sheath mounted around the at least one resilient component and in the at least one recess.

13. The footrest assembly as claimed in claim 1, wherein the seat mounting frame has at least one tracking slot formed in a side of the seat mounting frame, each one of the at least one tracking slot having a restraining hole formed through an inner surface of the tracking slot; and the tracking frame is movably mounted in the at least one tracking slot of the seat mounting frame, and has at least one restraining component mounted on the tracking frame, and movably mounted through the restraining hole of the at least one tracking slot.

14. The footrest assembly as claimed in claim 1, wherein the tracking frame comprises two sliding rods disposed in parallel and transversely spaced apart at a distance, and the two sliding rods are movably mounted in the seat mounting frame.

* * * * *